United States Patent [19]

Heisler

[11] Patent Number: 4,505,468

[45] Date of Patent: Mar. 19, 1985

[54] APPARATUS FOR ENGAGING AND MOVING CORRUGATED PAPERBOARD PORTIONS BY RECIPROCATED PINS

[76] Inventor: Raymond A. Heisler, 657 Dakota Trail, Franklin Lakes, N.J. 07417

[21] Appl. No.: 494,960

[22] Filed: May 16, 1983

[51] Int. Cl.[3] ..... B65H 3/22

[52] U.S. Cl. ..... 271/18.3; 221/213; 294/61; 414/730; 901/35

[58] Field of Search ..... 271/18.3, 19, 10; 414/730; 901/35; 221/213; 294/61, 100, 94, 110 A

[56] References Cited

U.S. PATENT DOCUMENTS

| | | | |
|---|---|---|---|
| 793,009 | 6/1905 | Miller | 271/18.3 |
| 3,240,358 | 3/1966 | Ferguson | 414/210 |
| 3,386,763 | 6/1968 | Ottaway et al. | 294/61 |
| 3,858,490 | 1/1975 | Heisler | 271/150 |
| 3,981,495 | 9/1976 | Bijttebier | 271/18.3 |
| 4,009,786 | 3/1977 | Littlewood | 271/18.3 |
| 4,089,150 | 5/1978 | Heisler | 53/452 |
| 4,372,548 | 2/1983 | Aurich et al. | 271/18.3 |
| 4,386,800 | 6/1983 | Stegall | 294/100 |
| 4,444,384 | 4/1984 | Keeton | 271/18.3 |

*Primary Examiner*—George E. A. Halvosa

*Assistant Examiner*—John A. Carroll

*Attorney, Agent, or Firm*—Ralph R. Roberts

[57] ABSTRACT

This invention pertains to pins carried by and in a retainer head member with the pins actuated when and as the head member and an associated contact member reaches the outermost portion of a paperboard member whereat the pins are caused to move obliquely to this surface and penetrate the paperboard sufficiently to engage and retain the paperboard. These pin ends by latch members are maintained in the desired penetrating position during transfer. This latch is actuated to release the projected pins when transfer is completed. The paperboard is conventionally of corrugated paperboard construction and the extent of pin end protrusion is carefully controlled so that the pin ends in the penetrating position do not protrude and penetrate the rear panel or wall of the paperboard so that only one penetrated paperboard member is transferred. The embodiments shown are adapted for use with paperboard which is not supple or flexible as is cloth or leather. The contacting member is disposed to establish and engage the outer surface of the paperboard member and the latch member is automatic in its operation during penetration and transfer. The latch is actuated to an open and release condition at the end of the transfer motion.

47 Claims, 27 Drawing Figures

FIG. 25 PRIOR ART U.S PAT. 3,858,490

FIG. 26 PRIOR ART U.S. PAT. 4,089,150

APPARATUS FOR ENGAGING AND MOVING CORRUGATED PAPERBOARD PORTIONS BY RECIPROCATED PINS

BACKGROUND OF THE INVENTION

1. Field of the Invention

The field of art to which this application pertains is believed to be found in the general class of sheet feeding or delivering (Class 271) with surface piercing elements and possibly the class pertaining to material or article handling (Class 414) in which the article is gripped and removed from a stack.

BACKGROUND OF THE INVENTION

A pre-Ex search was made in and of the art pertaining to the use of needles or pins to engage an article and move or remove said article from a stack. Corrugated paperboard generally in a flat folded condition are in Applicant's apparatus in which these sharpened pins are actuated and reciprocated. Folded flat box blanks are placed in a delivery apparatus having a chute. These blanks are withdrawn one-by-one for erecting, filling, sealing and delivery. U.S. Pat. No. 3,858,490 as issued Jan. 7, 1975 and U.S. Pat. No. 4,089,150 as issued May 16, 1978 to Raymond A. Heisler show apparatus for withdrawal of a flat folded carton from a delivery chute. The suction apparatus and cup used on the reciprocated arm anticipate and require vacuum apparatus and flexible conductors and/or manifolds which are expensive in use and maintenance. The soft rubber cups require replacement and at times are not one hundred percent effective in withdrawing a partially defective flat carton from a chute stack. Mechanical and positive apparatus in which an outer corrugated panel is penetrated without puncture of the rear panel member provides a more efficient and desirable apparatus.

In the course of the pre-Ex search the following U.S. Patents were noted: U.S. Pat. Nos. 793,009 to MILLER as issued June 20, 1905; 3,240,358 to FERGUSON as issued on Mar. 15, 1966; 3,386,763 to OTTAWAY et al as issued on June 4, 1968, 3,981,495 to BIJTTEBIER as issued on Sept. 21, 1976, and 4,009,786 to LITTLEWOOD as issued on Mar. 1, 1977. The MILLER reference is directed toward use in fabric, paper or leather and employs a rack and pinion gear to reciprocate the pins. FERGUSON has reciprocated pins but is used for leather or leather-like material. The piercing of only a thin paperboard panel is not shown or suggested. OTTAWAY is a pneumatic actuated apparatus and is for flexible material. BIJTTEBIER also uses a rotary action and the specification and claims are directed toward supple sheet material. LITTLEWOOD also provides a pneumatic mechanism with sequential engagement of the pins into the stack. The engagement and movement of supple sheet material or leather goods has been the subject of many patents, but flat folded corrugated boxes have been usually moved by vacuum cups actuated when pressed against a flat surface and the vacuum removed at the end of the transfer. Malfunction, wear and tear and cost of present apparatus are considered in the improved invention which is entirely mechanical.

SUMMARY OF THE INVENTION

This invention may be summarized, at least in part, with reference to its objects. It is an object of this invention to provide, and it does provide, apparatus for reciprocating a head member toward and to a corrugated paperboard. When this head member is brought into engagement with an exterior surface of the paperboard a plurality of pin portions are moved to pierce this outer surface of the paperboard and at an acute angle enter that space between opposed panel extents and with and by these engaged pins move this paperboard member to another location whereat the apparatus for engagement of the pins is reversed to cause the pins to disengage and release the paperboard member.

It is a further object of this invention to provide, and it does provide, apparatus in which a reciprocating head member carries a plurality of pin portions whose sharpened ends enter an exterior surface of a corrugated paperboard member and at an acute angle engage this paperboard member sufficiently to grasp said paperboard member and transfer this member to another location. These pins are reciprocated and when in the determined extended and gripping condition a latch means is actuated to maintain the gripping condition of the pins as and when the transfer action is made. At the termination of the transfer, the latch means is actuated to remove the latch retention and the engaged pins are withdrawn from the paperboard.

The prime purpose of this invention is to provide a positive mechanical gripping of a flat paperboard carton and transfer the flat carton to erecting and filling operations as noted in the above referenced patents U.S. Pat. Nos. 3,858,490 and 4,089,150 in which suction is used to grasp the lowermost carton and transfer it from a chute. The pins in the exemplified apparatus are carried by a swing arm but this is not to preclude apparatus which may be on other than swinging arms. The pins and the associated apparatus are used with reciprocated apparatus and contemplates latch means that is actuated when the pin carrying head is brought in contact with the paperboard member. This latch means remains in engagement to prevent withdrawal of dislodgement of the pins during transfer movement. At the end of the transfer movement the latch is actuated to cause a release whereupon the pins are withdrawn from the paperboard and a release of the carton is achieved.

Several concepts or embodiments of the invention are depicted and all have a plurality of pins or pin ends that are actuated as and when the pin carrying head or apparatus reaches the surface of the paperboard product. This product is usually a flat carton of corrugated construction and the pins are so constructed, disposed and actuated so that penetration of the paperboard is only through the exterior surface member and possibly into the corrugated filler but in no embodiment is it contemplated that the needle or needles penetrate the rear or opposite wall of the corrugated paperboard.

In brief, the several embodiments show a plurality of needles carried in a head member having an engaging member portion that is adapted to contact the outermost surface of the paperboard and with engagement the continued movement of the needle retaining head causes the needles to penetrate the paperboard so as to engage the paperboard in and with a gripping action. The purpose of the mechanism containing the needles and head member is to transfer the paperboard member and so a latch means is provided to insure that the needles are in retaining position during the transfer and at the end of the transfer motion the latch is disengaged and the needles are caused to be withdrawn.

The pins and retaining member may be actuated or moved by a pneumatic or hydraulic cylinder or a mechanical member. In the above referenced patents to HEISLER there is shown a swinging arm that is reciprocated towards and to a chute into which are fed flat corrugated cartons and one-at-a-time these flat cartons are withdrawn from this chute by suction means. In the present apparatus the pins are conventionally arranged in a defined pattern which may be circular or in a more-or-less straight line. These pins may be arranged to be moved toward or away from each other depending upon the rigidity of the surface member of the corrugated carton.

The pins are shown as leaf springs made from spring steel and biased to a given position. Like or similar pins may be pivoted and moved by resilient means such as rubber or rubber-like material or a coil spring. The pin arrangement may be actuated by cam means arranged to actuate several pins at one and the same time. In a preferred embodiment the pins are arranged in a comb-like array and intermesh with one another so as to utilize or occupy minimum space.

In each embodiment the pin member carries an engaging portion that contacts the exterior surface of the corrugated paperboard and is so adapted that a continued forward movement of the pin retainer member causes the pins to be actuated to penetrate the outer member of the paperboard. It is also contemplated that a latch means is provided in all instances so that after the desired penetration is made to effect a desired grasping of the paperboard a transfer of the paperboard product is made with the latch means effective to maintain the pin penetration. At the end of the transfer movement the latch is actuated to remove the latch retention and cause the pin projection portions to be withdrawn from the paperboard product.

In the several embodiments the pin members are shown with a retaining sharpened inner end that provides the attaching portion of the pin portion. The pins are contemplated to be substantially the same length and to be commercially produced so that rather than resharpening, the pin portions are discarded and replaced by new members having an established configuration. There is also shown an embodiment in which the pin portions are made of and with a NEGATOR type spring which is configured to wind upon itself.

In addition to the above summary the following disclosure is detailed to insure adequacy and aid in understanding of the invention. This disclosure, however, it not intended to cover each new inventive concept no matter how it may later be disguised by variations in form or additions of further improvements. For this reason there has been chosen specific embodiments of apparatus for engaging and moving corrugated paperboard articles by reciprocated members as adopted for use in moving flat corrugated articles from a stack or chute and showing preferred means for limiting the penetration of a plurality of pins and latch means to retain the article during transfer. This specific embodiment has been chosen for the purpose of illustration and description as shown in the accompanying drawings wherein:

BRIEF DESCRIPTION OF THE DRAWINGS

FIG. 19 B represents a top or plan view, also partly diagrammatic, and showing the pin end of FIG. 19 A advanced and in the guided and retained condition, this view taken on the line 19 B—19 B thereof and looking in the direction of the arrows;

FIG. 25 represents a side view of the arm and pneumatic cup used with the prior art apparatus of U.S. Pat. No. 3,858,490, and FIG. 26 represents a side view of the arm and pneumatic cup used with the prior art apparatus of U.S. Pat. No. 4,089,150.

In the following description and in the claims various details are identified by specific names for convenience. These names are intended to be generic in their application. Corresponding characters refer to like members throughout the several figures of the drawings.

EMBODIMENT OF FIGS. 1 THROUGH 4

In all embodiments utilizing and showing sharpened pin assemblies it is contemplated that engaging means will be provided so that the paperboard member, when engaged, has only the outermost portion or sheet penetrated by the sharpened pin ends which also may enter the corrugations forming the intermediate portion of the paperboard member. In no case is it contemplated that the sharpened pin ends pierce and/or protrude from the rear panel member as this would defeat the purpose of the sharpened pin actuation during grasping and transfer.

Figure 1:
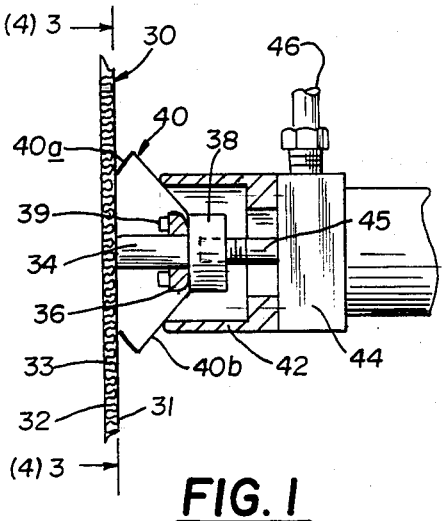
FIG. 1 represents a fragmentary side view, partly in section and diagrammatic, and showing a plural pin arrangement carried in a retaining head means and showing a pneumatic cylinder used as a check valve.
Figure 2:
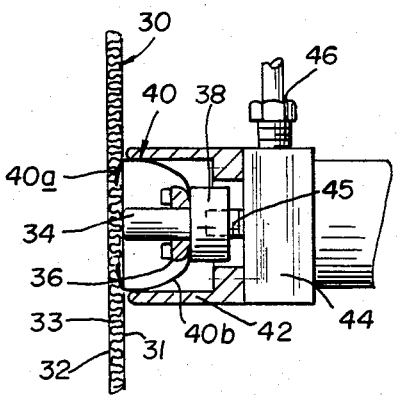
FIG. 2 represents the fragmentary side view, partly in section and diagrammatic, and showing the head of FIG. 1 with the plural pins actuated so as to cause the sharpened end to penetrate the outermost wall of a paperboard member.
Figure 9:
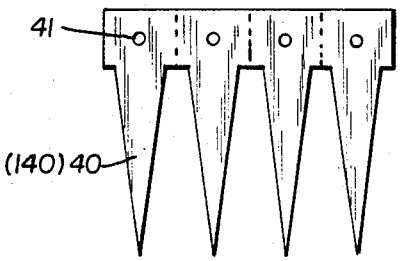
FIG. 9 represents a plan view, partly diagrammatic and showing a typical configuration of a plurality of pins arranged for ready replacement and installation.

As depicted in FIGS. 1 and 2, a corrugated paperboard 30 is shown as a single member for illustration purposes but in reality is usually in a stacked side-by-side contiguous relationship. Corrugated board, whether paperboard or cardboard, is conventionally made with front and rear panels or sheets 31 and 32 and with glue, not shown, is stiffened or strengthened by a corrugation member 33 that is affixed between these panels. In this apparatus a sensing plunger 34 projects from a retainer collar 36 and a support member 38. Screws 39 enter threaded holes formed in this member 38 and retain spring pins 40 by holes 41 formed in the sharpened pin. These holes are depicted in FIG. 9.

In this embodiment of FIGS. 1 and 2, the pins 40 are of spring steel and have the sharpened forward end portion formed with an angle of about eighty to ninety degrees. This forward end portion, for the purpose of identification, is 40*a* and the rear portion is identified as 40*b*. An actuating member 42 may be a ring or collar when the pins 40 are disposed in a circle or may be a U-shaped channel member (FIG. 4) when the pins are arranged in a rather straight line array.

Member 42 is carried by and secured to a pneumatic or hydraulic cylinder 44 by screws or the like. The cylinder is small and light in weight with a rod 45 and from this cylinder there is a small conduit 46 which leads to an actuatable valve not shown.

Use and Operation

In use and operation the paperboard member 30 is usually supplied in a chute to be filled and withdrawn therefrom by actuated means. Prior to this invention suction and suction cups were utilized. In Applicant's invention the sensing plunger 34 is advanced toward and to the panel surface 31 of the paperboard member 30. When this plunger engages this surface 31 the plunger and piston rod 45 stop their movement but member 42 continues to move toward the paperboard 30. Member 42 engages the rear portion 40*b* to cause the forward end 40*a* to pierce and enter the paperboard member 30 and as seen in FIG. 2 the penetration is short of the rear panel or sheet 32. The forward movement of member 42 is terminated with the desired penetration of the paperboard. The valve in the conduit is shut off and the desired transfer movement is begun. The valve causing the cylinder 44 to remain in the engaging position of FIG. 2 is actuated at the desired termination of the transfer movement and the spring action in the cylinder 44 is employed to cause the forward end of the sharpened pins 40*a* to be removed from the paperboard after which the transfer movement is repeated to bring the apparatus to the engaging condition of FIG. 1 whereat the next member in the chute is presented to the mechanism. It is to be noted that collar 36 is shown with a thread so as to be easily mounted on the threaded end of the piston rod 45.

Figure 3:
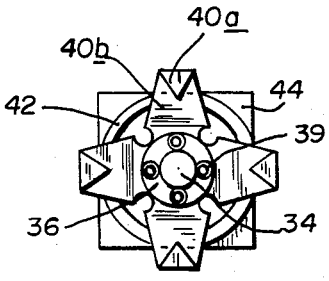
FIG. 3 represents a face view, partly diagrammatic, of the plural pin apparatus of FIG. 1 with the pins arranged in a circle, this view taken on the line 3—3 thereof and looking in the direction of the arrows.

Embodiment of FIG. 3

In FIG. 3 the spring pins 40 are arranged as four in number and ninety degrees from each other. Cylinder 44 is shown with a square mounting end and actuating member 42 is shown as tubular. Screws 39 may be employed to secure collar 36 to support 38 or other means such as drive pins may be employed.

Figure 4:
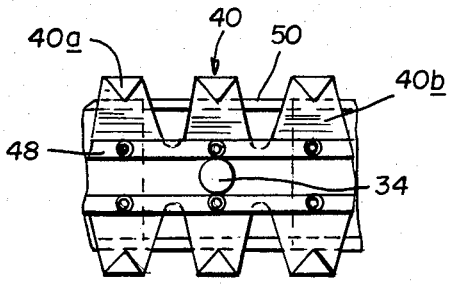
FIG. 4 represents a face view, partly diagrammatic, of the plural pin apparatus of FIG. 1 but with the pins arranged in facing and parallel rows, this view taken on the line 4—4 thereof and looking in the direction of the arrows.

Embodiment of FIG. 4

In FIG. 4 the spring pins 40 are shown as formed and mounted in a linear arrangement. The spring pins 40 may be individual portions as in FIG. 9 or may be of a strip of metal bent to shape and with a plurality of sharpened ends. The securing of these pin portions 40 may be by linear strips 48 or by a single strip with an aperture through which the sensing plunger 34 extends. Rather than a round actuating member 42 as in FIG. 3 this longitudinal arrangement utilizes a channel shaped member 50 which otherwise performs as does member 42 when the pins 40 are bent to the engaging configuration of FIG. 2.

Figure 5:
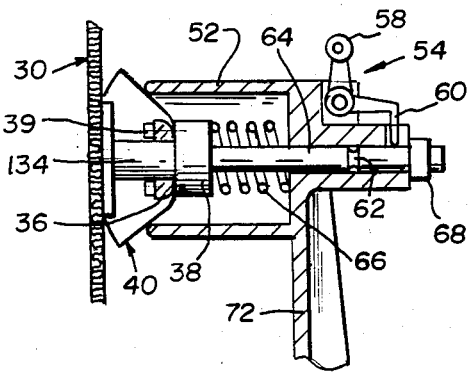
FIG. 5 represents a fragmentary side view, partly diagrammatic and in section, and similar to the apparatus of FIG. 1 but with a latch means provided by a levered cam mechanism.
Figure 6:
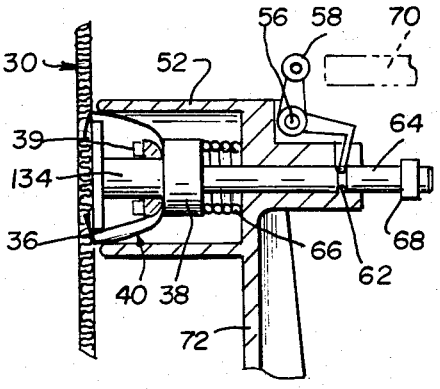
FIG. 6 represents the fragmentary side view, partly in section and diagrammatic, and showing the apparatus of FIG. 5 with the latch means, now in retaining engagement.

Embodiment of FIGS. 5 and 6

The apparatus of FIGS. 5 and 6 is very similar to that of FIGS. 1 and 2 but rather than utilizing the cylinder 44 and valve as a retaining means during transfer movement there is depicted a latching apparatus. The paperboard 30, sensing plunger 34, retaining collar 36, support member 38, screws 39 and pins 40 are like or very similar to that in FIGS. 1 and 2 above described. An actuating member 52 is similar to member 42 but has a hinge support for a pivoted cam member 54. This member is rotatable around a pivot pin 56 with its exterior end having a roller 58 and at its other end having an engaging finger 60 disposed to enter a groove 62 formed in shaft 64. A coil spring 66 urges the actuating member 52 outwardly. A collar 68 is shown as providing a limit stop to the forward travel of the shaft 64. A trip member 70 is shown in FIG. 6 and this trip member 70 is disposed to engage roller 58 at the end extent of transfer movement and cause the engaging finger 60 to be moved from groove 62 and the sharpened pin ends to be moved to the condition of FIG. 5.

Use and Operation of FIGS. 5 and 6

The apparatus of FIGS. 5 and 6 is very like that of FIGS. 1 and 2 but shows another means for providing a latch for retaining the engaged pins 40 in the paperboard 30 during withdrawal and transfer. This apparatus performs like the above but in this embodiment there is a suggestion of a transfer arm member 72 by which the head assembly as depicted is moved toward and to the paperboard 30 and with the forward movement the sharpened forward pin ends 40*a* enter the paperboard as in FIG. 6. At the forward extent the engaging finger 60 enters groove 62 to retain this engaging condition of FIG. 6 during withdrawal and transfer of the paperboard 30. As the transfer movement approaches its termination the roller 58 engages trip member 70 and the finger 60 is moved from the groove. The head assembly again returns by the spring 66 to the condition of FIG. 5. The pins 40 may be arranged in a circular array as in FIG. 3 or may be linearly disposed as in FIG. 4 to suit the conditions of the withdrawal and transfer of the paperboard.

Figure 7:
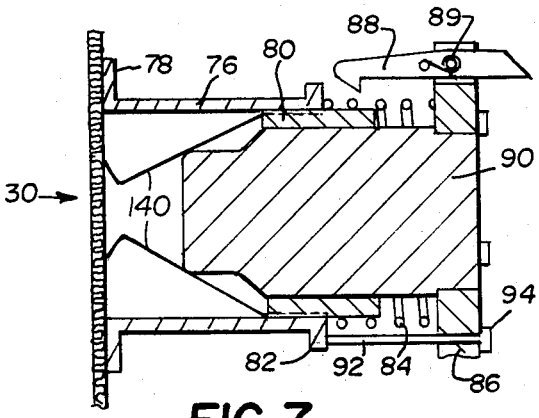
FIG. 7 represents a fragmentary side view of yet another plural pin assembly, this view partly diagrammatic and in section and showing a cam means for simultaneously actuating the plurality of pins and depicting a latch means for retaining the pins in an engaged condition during a transfer movement of the pin retainer.
Figure 8:
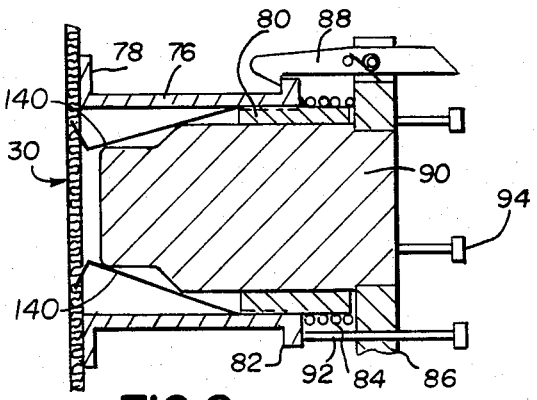
FIG. 8 represents the fragmentary side view of the pin assembly of FIG. 7 and showing the plurality of pins in an engaged condition.

Embodiment of FIGS. 7 and 8

This embodiment shows apparatus or mechanism for sharpened pins that are disposed so as to be moved outwardly. The paperboard 30 is like that in the FIGS. above and the sharpened pins now identified as 140 are of metal and are spring biased to the condition and position of FIG. 7. Instead of a sensing plunger 34 as in the above embodiments there is shown a sleeve member 76 which may be substantially tubular and when the pins 140 are arranged in circular pattern or array the sleeve member is also substantially circular. This sleeve member 76 has an outwardly extending lip 78 so as to provide an extensive contact surface. The sharpened pins 140 are retained between the sleeve member 76 and an inner sleeve member 80. A latch extension or lip 82 is secured to and is carried with and by sleeve member 76. A compression spring 84 is disposed between inner sleeve member 80 and a retaining member 86. In this retaining member is pivotally mounted a latch dog 88 and having a conventional sloped outer or leftwardly extending end. This latch dog is spring biased by spring 89 toward a cam member 90. This latch dog bias movement is indiciated by the arrow and a limiting means is contemplated for inner and outer extent of movement. Sleeve 76 is not only supported by retaining member 86 but there must be guide means for reciprocal movement of this sleeve against the bias of spring 84. A plurality of rods 92 may be provided to engage and be retained by sleeve 76. These rods are slidable in appropriately provided apertures in this header member 86. A collar 94 is provided on each rod to limit its forward movement as provided by the bias of spring 84.

Use and Operation of Embodiment of FIGS. 7 and 8

The embodiment depicted in FIGS. 7 and 8 show sharpened pins 140 which are disposed to be moved outwardly away from each other to provide the engaging of the paperboard with a potential tensioning of the outer and engaged surface member. At and with the engagement of the surface of the lip 78 to board 30 the forward progress of the sleeve member 76 ceases and cam member 90 continues forwardly to cause the plurality of sharpened pins 140 to be moved to the condition and position of FIG. 8. Spring 84 is compressed to provide the desired bias for retracting the pin apparatus. Latch dog 88 is moved into engaging relationship with extension or lip 82 and retains the sharpened pin ends 140 in engaged condition during transfer movement of the apparatus. Means is provided to cause latch dog 88 to be moved to a release condition and the apparatus to return to the condition of FIG. 7. Retaining member 86 is conventionally a portion of the movable arm but may be a reciprocated member not swung in an arc. One or more latch mechanisms may be employed and actuating means for release movement at a desired position is merely a matter of selection. Whether the sharpened pins 140 are arranged in a circle as in FIG. 3 or linearly as in FIG. 4 is also a matter of selection. Combinations of arrangements may also be provided if desired. Rods 92 are depicted as connected to or made a part of the sleeve 76 but other appropriate limiting means may be provided to limit the outward movement of sleeve 76 against the bias of spring 84.

Figure 10:
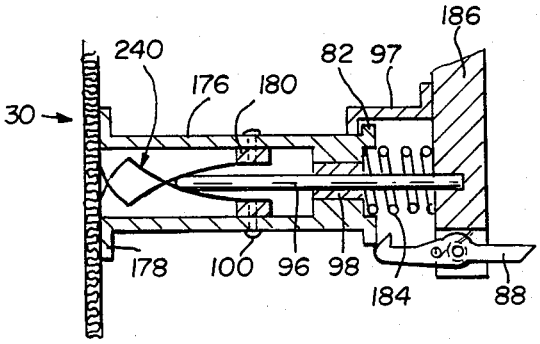
FIG. 10 represents a fragmentary side view, partly in section and diagrammatic, of yet another assembly of pins held by apparatus with latch means for retaining the pins in an engaged condition during transfer.
Figure 11:
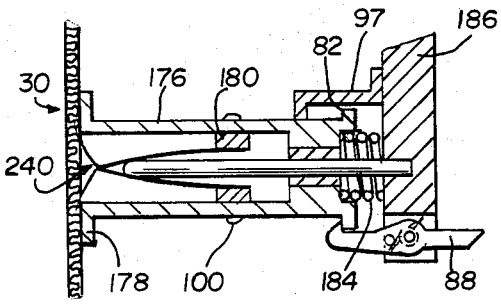
FIG. 11 represents the fragmentary side view of the pin assembly of FIG. 10 but with the pins extending in a retaining condition.

Embodiment of FIGS. 10 and 11

In FIGS. 10 and 11 there is shown yet another arrangement wherein the sharpened pins of FIG. 10 are actuated outwardly and away from each other to provide the engaging position of FIG. 11. Paperboard 30 is similar to or identical with the corrugated member above described. Retaining member 186 is like member 86 of FIGS. 7 and 8 and carried thereby is a sleeve member 176 having outwardly extending lip portions 178 disposed to engage and be stopped by the facing surface of the paperboard 30. A latch dog 88 is adapted to engage lip 82 as above described. This latch dog 88 is spring-biased by spring 89 toward the lip 82 to move into a retaining engagement when pin ends 240 are moved into engaging condition. A cam and expanding member 96 is adapted to enter between the pin ends 240 to cause the sharpened ends to penetrate the paperboard 30 as above described. The cam and expanding member 96 is shown as secured and carried by retaining member 186 and is moved therewith. Also secured to and carried by member 186 are Z-shaped guides and retainers 97 which are attached at one flange end to member 186 but at their inner (left) end are provided with a guide and retainer flange with the inward surface providing a guide for the sleeve 176. A bearing means 98 is shown as carrying the cam and expanding member 96.

Spring biased sharpened pin ends 240 are retained at their inner ends by a collar 99 which is secured to the sleeve 176 by screws or rivets 100. A compression spring 184 is disposed to engage and urge outwardly the sleeve 176. Latch means such as shown in FIGS. 7 and 8 may be employed to maintain the engaged condition of the sharpened pins during transfer movement of the member 186.

Use and Operation of FIGS. 10 and 11

The arrangement of FIGS. 10 and 11 is much like that shown and described in connection with FIGS. 7 and 8 but the pin ends are formed to provide an intermesh and occupy less space. These pin ends may be arranged in a circular pattern or in a linear array. Cam member 96 urges the intermeshed sharpened pin ends from the condition and position of FIG. 10 to the condition and position of FIG. 11 wherein the latch 88 as urged by spring 89 drops over lip 82 and into a retaining condition. The latch 88 is actuated into an open condition at the end of the desired transfer movement by a member not shown. The guide retainer 97 assists the member in maintaining member 176 in the desired orientated condition. A latch 88 is adapted to engage the rear outward lip of member 176 no matter the orientation. It is anticipated that wear on the sharpened pin ends 240 and the cam member 96 will be easily corrected by replacement.

Figure 12:
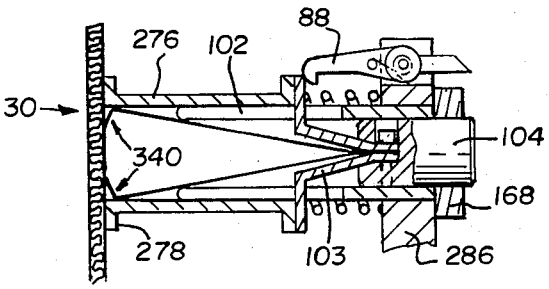
FIG. 12 represents a fragmentary side view, partly in section, and showing diagrammatically yet another pin arrangement and means for actuating the plural pins into engaging condition.
Figure 13:
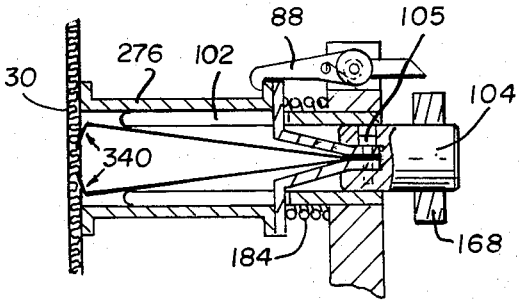
FIG. 13 represents the fragmentary side view of the apparatus of FIG. 12 with the pins now moved to an engaging condition.

Embodiment of FIGS. 12 and 13

The embodiment of FIGS. 12 and 13 is much like that of FIGS. 10 and 11 in that the sharpened pins are disposed to enter and engage the paperboard 30 with an outward movement but rather than a central cam 96 as described above in FIGS. 10 and 11, in this embodiment a sleeve member 102 provides this actuation. A retaining sleeve 276 with a lip 278 is similar to or identical to the sleeve 176 and lip 178 of FIGS. 10 and 11. Pin members 340 are configured substantially as shown and are retained at their inner or right ends by L-shaped retainers 103. Sleeve 276 is secured to the L-shaped members or retainers 103 and spring or springs 184 provide the desired bias to urge sleeve 276 away from retaining member 286. Sleeve member 102 is secured to retaining member 286 so as to be moved therewith. A collar or stop 168 is secured to a member 104 which may be a tubular member or may be a rod portion adapted to retain the pair of L-shaped members so that these L-shaped members 103 and sleeve 276 are movable within limits independently of the retaining member 286. Pins 105 are adapted to retain L-shaped members 103 in the desired attitude. Retention of these L-shaped members to the sleeve 276 and to a member 104 and/or to an exterior end member is a matter of selection.

Use and Operation of Embodiment of FIGS. 12 and 13

In this embodiment it is contemplated that the paperboard 30 is contained or presented in a stacked array. The lip 278 engages the outwardly or facing surface of the paperboard to stop the leftward advance of the sleeve 276. Sleeve member 102 engages the sides of the pin members 340 to cause the sharpened end to pierce and penetrate the paperboard 30. This is depicted in FIG. 13. This sleeve member 102 is moved against the bias of spring 184 when the support member 286 is moved forwardly. The stop 168 limits the positioning of the sharpened ends of the pins 340 when in the position of FIG. 12. The member 104 may be tubular or a rod-like member when and where the pins 340 are arranged in a circular pattern. End plates may be used when the pins 340 are arranged in a more-or-less straight line similar to FIG. 4. Sleeve 102 may be tubular with slots or may be leaf members interposed between L-shaped members 103 with the leftward portions of these sleeve portions retained by sleeve 276 to prevent deflection.

Figure 15:
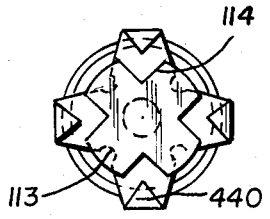
FIG. 15 represents a face or front view, partly diagrammatic and in an enlarged scale, of the head apparatus of FIG. 14, this view taken on the line 15—15 thereof and looking in the direction of the arrows.
Figure 14:
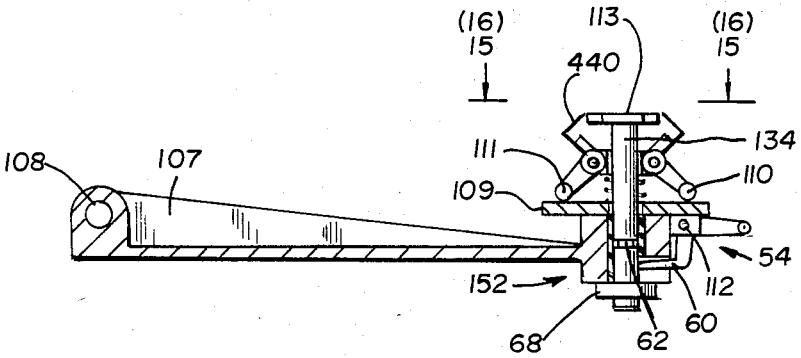
FIG. 14 represents a fragmentary side view, partly diagrammatic, of an arm and pin actuating apparatus carried therewith.
Figure 16:
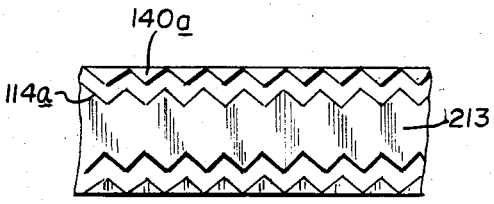
FIG. 16 represents a face or front view of the head apparatus and in an enlarged scale of the pin retaining apparatus of FIG. 14, this arrangement providing pins arranged in a parallel array, this view taken on the line 16—16 thereof and looking in the direction of the arrows.

Embodiments of FIGS. 14, 15 and 16

In the embodiments of FIGS. 14, 15 and 16 there is shown a swing arm 107 which is retained at one end by bracket or mounting member 108. At the other end of this arm is secured an actuating member 152 very similar to that shown in FIGS. 5 and 6. This support bracket or member 152 is shown with a pressure plate 109 adapted to move rollers 110 carried on the lower end of pivoted arms 11. The other leg portion of each arm 111 carries a sharpened pin 440. Plate 109 carries a fulcrum 112 which provides pin retention for support of the pivoted cam member 54. A sensing plunger 134 has a groove 62 therein and at its engaging end has a contacting plate 113 which has appropriately shaped cutouts 114 for passing the sharpened pins 440.

In FIG. 15 there is shown a fragmentary view of the sharpened pins 440 arrayed in a circular pattern with cutouts 114 formed in the pressure contacting plate 113. In FIG. 16 the sharpened pins are arrayed in a dual linear array with the sharpened ends 440 moving past each other. Cutouts 114 a provide means for moving the sharpened ends of the pins past plate 213. It is also contemplated that the sharpened pins may be arranged so as to be moved outwardly into a holding condition as shown in FIGS. 10, 11, 12 and 13.

Use and Operation of the Embodiments of FIGS. 14, 15 and 16

These embodiments are very similar to the operation and use described in connection with FIGS. 5 and 6. In the embodiment of FIG. 14, arm 107 is very like arm 72 but carries sharpened pins 440 in a slightly different manner. As seen in FIG. 15, these pins are arranged in a circular array and in FIG. 16 said pins are arranged in substantially parallel and linear array. This actuating bracket or member 152 is moved with and by arm 107 in an arc and the attached pressure plate 109 is carried and moved with this member 152. As and when the sensing plunger 134 and attached plate 113 engages the outer surface of a paperboard, not shown, the plunger 134 is moved so that groove 62 comes in way of and is engaged by the end of finger 60 of the pivoted cam member 54. The same actuation is contemplated in both the array of FIG. 15 and FIG. 16.

With the swinging forward of the arm 107 the plate 109 is urged toward the paperboard and with contact thereof by plate 113 the movement of plate 109 causes pivoted arms 111 to be rotated about their axis and the sharpened ends are caused to penetrate the paperboard. Engagement of the pin ends is maintained during withdrawal and transfer as the finger 60 engages and seats in the groove 62 in the manner above described in conjunction with FIGS. 5 and 6. A trip release means is provided at a prescribed position to cause this cam member 54 to be moved and release the pins to the retracted position of FIG. 14.

It is to be noted that the contacting plate member 113 is contoured to provide movement of the sharpened pins 440 into the penetrating condition and position. This plate 113 is contemplated to provide the desired or required protection to the sharpened ends of the pin assemblies but an exterior protection or shroud may be provided if desired. The pins may be arranged in a circular or oval pattern or may be arranged in a substantially parallel array as **440*a* as desired. The collar 68 is indicated as providing the desired limit to the outward movement of the plunger 134 but other means may be provided if desired. The pivot of arms 111 are carried with and by plunger 134 and are moved as this plunger is moved. Either the array of FIGS. 15 or 16** anticipate such support.

Embodiment of FIGS. 17 through 20

Figure 17:
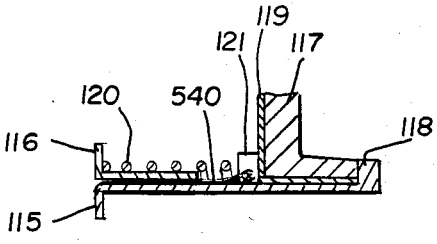
FIG. 17 represents a fragmentary side view, partly in section and diagrammatic, and depicting a plurality of pins with each being made from a Negator-type spring member, this view showing the spring in a substantially retracted or non-engaging condition and position.
Figure 18:
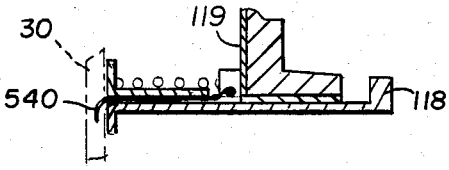
FIG. 18 represents the fragmentary side view of the apparatus of FIG. 17 but with the Negator spring advanced into engaging condition.
Figure 19A:
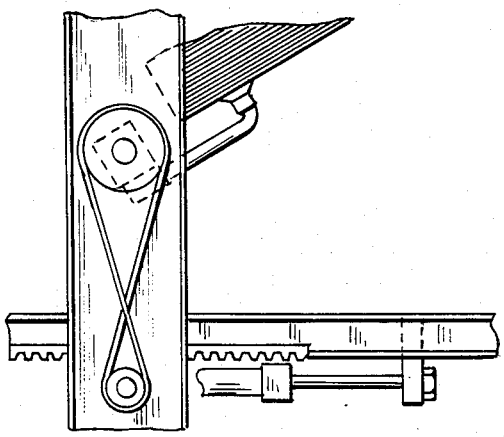
FIG. 19 A represents a side view, partly diagrammatic, of the pin of FIG. 17 and showing a sharpened pin end member (Negator-type spring) in the guided and retained condition before penetration into the paperboard.
Figure 19A:
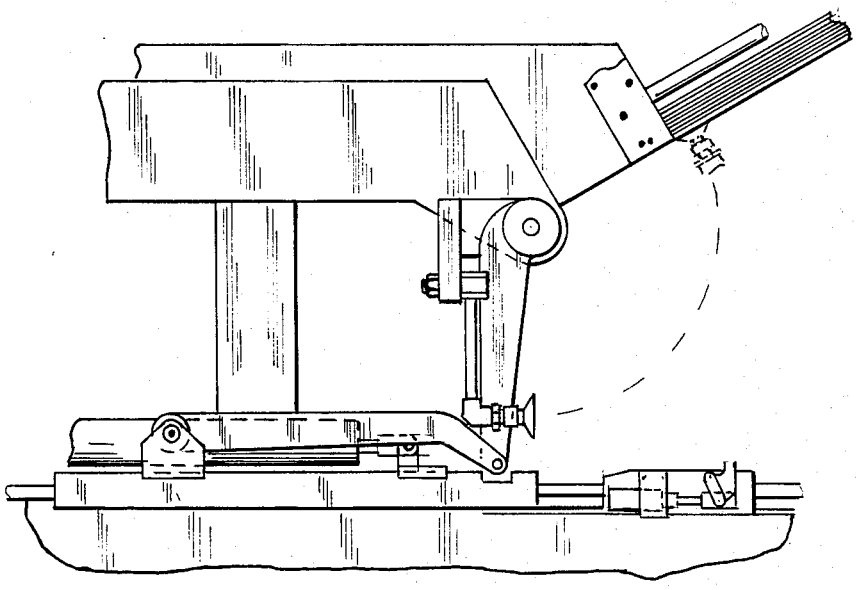
Figure 19A:
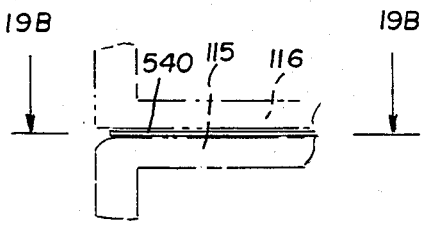
Figure 19B:
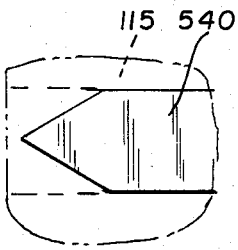
Figure 22:
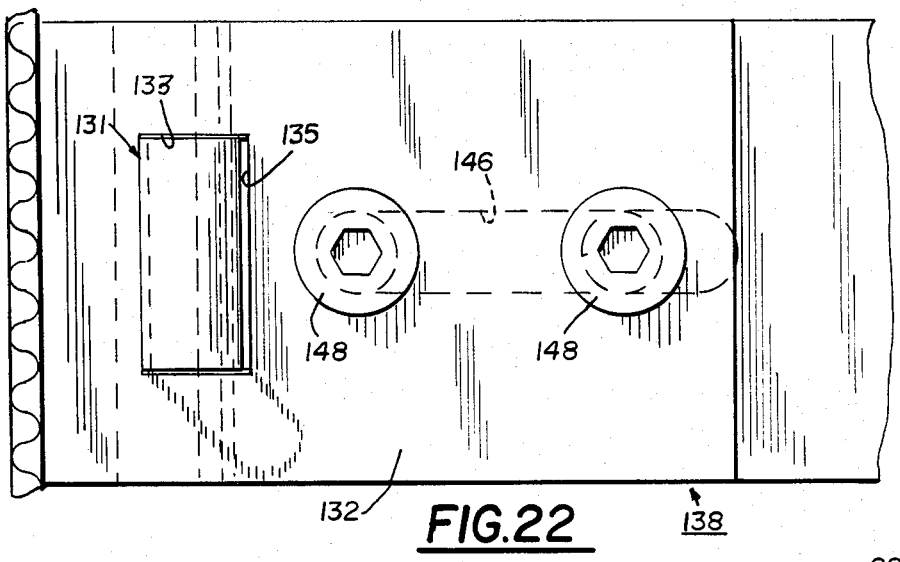
FIG. 22 represents a top or plan view of the embodiment of FIG. 21, this view taken on the line 22—22 hereof and looking in the direction of the arrows.

In FIGS. 17 through 20 there is depicted sharpened pin ends wherein the pin member is made of a coiled spring commonly identified as a self-coiling (negator) spring and characterized as coiled tightly. Such constructions are found in pull tapes and in many commercial applications where it is desired that the coils lay in a contiguous manner. Springs 540 have one end sharpened and are moved within guide members 115 and 116. It is to be noted that, as depicted, guide member 115 is radiused at its outer corner edge to provide a curved guide surface for the emerging spring end and allow it to enter the paperboard 30 and curl as in FIGS. 18 and 20. FIGS. 17 and 18 are fragmentary and diagrammatic and the depicted springs 540 may be arranged to turn outwardly away from each other or to turn inwardly toward each other.

Figure 20:
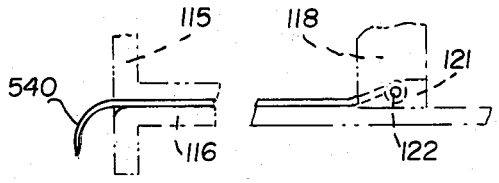
FIG. 20 represents a view of the spring pin as shown in FIG. 18 and with the sharpened end of the spring extending beyond the guide means.

The guide member 115 provides a slidable surface and guide for the movement of actuator 117 which is usually an arm member. A stop 118 is provided with guide 115 so as to limit the movement of guide 115 relative to the position of actuation 117. A spacer 119 may be provided to precisely position the end of the spring 540 with the outer faces of the guides 115 and 116. A coil spring 120 is provided to provide a bias for relative movement of guide member 115 to guide member 116. A retaining lug 121 is disposed to accept and retain the other end of spring member 540. This lug is moved by actuator 117. The shape of the sharpened pin ends 540 is essentially an acute point and this showing is seen in FIGS. 19 A and 19 B wherein the spring member is shown as made with a sharp end. The showing in FIG. 20 depicts a retaining means whereby the spring body at its inner or right end is secured to lug 121 by screw pins 122.

Use and Operation of Spring of FIGS. 17 through 20

In this embodiment it is contemplated that the sharpened pins are made of spring steel and as formed are coiled to lay substantially one on the other. The guide members 115 and 116 may have anti-friction facing surfaces for enabling the spring member 540 to be easily moved in and out. In use it is contemplated that a plurality of sharpened pins are mounted in a selected array either circular or linear as above indicated. With the forward movement of actuator 117 which is usually a portion of an arm, the lips on guides 115 and 116 approach and contact the facing surface of a paper board 30. Actuator 117 continues to move forwardly until a limit, not shown, is reached. This limit brings the embodiment to the position and condition of FIG. 18 whereat the actuator 117 moves retaining lug 121 and the secured spring 540 from the position and condition of FIG. 17 to the condition and position of FIG. 18.

The spring end moves forwardly between the guide members 115 and 116 so that the sharpened end not only penetrates the outer surface of the paperboard 30 but also may penetrate the corrugations therein. The spring 540 is so constructed and moved that the sharpened end does not penetrate the rear panel portion as it forms a curved or arc-like component. As this sharpened end is pushed from between the guide members 115 and 116 said end enters the paperboard as in FIG. 18 and with movement of the actuator 117 this engaged and retained paperboard is transferred. The embodiment of FIGS. 17 through 20 does not show a latching means to maintain the condition of FIG. 18 during transfer but any latching means as suggested above is contemplated to be used with this embodiment.

Embodiment of FIGS. 21, 22 23 and 24

In this embodiment is depicted an easily replaced pin end member 131 which is of spring tempered metal. This member is conventionally of spring steel which is tempered after shaping. From a blank of metal (usually spring steel) the shape is made so that pin end member 131 may be quickly replaced when the sharp points or ends wear beyond effective use. This member has a rear wall 131*a;* a front wall portion 131*b;* a forwardly sloped portion 131*c* that is an extension of the solid front wall 131*b*. A comb-like portion is formed on the forward end of member 131 and is partcularly seen in FIG. 23 and FIG. 24 in which a series of triangular portions 131*d* are provided. These end portions have sharp ends which are bent upwardly at and are identified as 131*e*. The arch providing the spring bias is identified as 131*f* and the beveled rear edge is identified as 131*g*.

This spring metal pin end member 131 is used in and retained by a top plate 132 in which a rectangular opening 133 is formed and the rear edge 135 is sloped to provide a desired clearance for member 131. A lower or bottom plate 136 is also provided but there is no aperture 133 shown in this plate. A movable member 138 includes a shaped forward end 140 whose nose portion is adapted to move the forward portion of spring metal member 131 in a controlled arc. Adjacent to the forward end is a series of serrations or notches 142 which are shaped to receive and retain the beveled end 131*g* of member 131. An extending rear end portion 144 of member 138 may be attached or form a part of the arm actuator mechanism not shown. A slot 146 is formed in the midlength of said movable member 138. In this slot are passed cap screws 148 and nuts 149 retain the threaded ends of said screws.

It is to be noted that the portion of member 131 within the inner faces of members 132 and 136 has sufficient bias to act as a spring means to urge movable member 138 rearwardly until stopped by the shank of cap screw 148 and the slot 146. This spring bias is also contemplated to be sufficient to effect withdrawal of the sharpened ends 131*e* from the paperboard 30.

Use and Operation of Embodiments of FIGS. 21 through 24

This embodiment contemplates that the rear end portion 144 may be attached to an arm of a machine in which carton erecting is one of the steps. Assembly of this embodiment is rather easy as two cap screws 148 are used to secure said top 132 and bottom plates 136 in the desired retained position. The bend between 131*b* and 131*c* establishes the mounted retention of member 131. Member 131 is preferably of spring steel and portions 131*a*, 131*b*, and 131*g*, when inserted into a selected notch 142, uses the springbias in and of the arch portion 131*g* which is sufficient to maintain the member 131 in the rectangular opening 133. The portion 131*c* provides a spring bias sufficient to cause the sharpened ends 131*e* to be withdrawn from the paperboard 30 and urge movable member 138 rearward when withdrawal is to be made. Replacement of member 131 is quick and easy. The forward cap screw 148 is removed and with a slight upward motion the rear edge 131*g* is lift from in way of notch 142. The absence of the forward cap screw allows movable member 138 to be moved rearwardly and the member 131 is then lifted from and through the rectangular opening 133. A replacement member 131 is now positioned. The forward cap screw 148 is again inserted into the slot 146 and retightened into the desired position. The desired bias is established with the bevel edge 131*g* of the member 131 inserted into one of the notches 142.

It is to be noted that the portion of member 131 within the inner faces of members 132 and 136 has sufficient bias to act as a spring means to urge movable member 138 rearwardly until stopped by the shank of cap screw 148 and the slot 146. This spring bias is also contemplated to be sufficient to effect withdrawal of the sharpened ends 131*e* from the paperboard 30. The side view of member 131 shown in FIG. 24 indicates that as formed said member has portion 131*a* canted slightly less than vertical and the portion 131*b* is also canted forwardly. In the mounted condition the portion 131*f* is bent to provide a spring bias when actuated.

It is to be noted that the member 131 in a free condition is disposed at a slight angle rearward of portion 131*a* which portion is brought to a substantially vertical condition when the member 131 is in mounted condition. These leg portions 131*a* and 131*b* are so formed that in mounted condition the arch portion 131*f* is stressed sufficiently to provide the desired spring bias to urge member 138 rearwardly until the forward cap screw 148 is passed through slot 136 and retained.

It is to be also noted that the top plate 132 and the bottom plate 136 may be identical as the opening 133 and rear edge 135 are not required in a bottom plate but will not affect the operation. Notches 142 may also be formed on the opposite side of movable member 138 so that symetrical machining and positioning of this member may be achieved. The plates 132 and 136 are indicated with lip portions (phantom outline) to increase the contact area of the plate ends against the paperboard 30. If and when lip portions are provided they are a matter of selection and extent.

The slot 146 allows forward travel of member 138 until the rear end of slot 146 meets the shank of screw 148. The positioning of the shank of the rear cap screw in the slot 146 establishes the forward limit of the movable member 138. Arm attachment and means for establishing gripping retention until the end of a transfer motion has been shown in the other above embodiments and this is a matter of selection and choice. Release actuation of movable member 138 may be by any of the above release or latches shown and this release is at the end of the transfer motion. The bias in member 131 that is within the inner faces of plates 132 and 136 is sufficient to effect withdrawal of the sharpened ends from the paperboard 30 and into the withdrawal position and causes the movable member 138 to be moved against the shank of forward cap screw 148.

Figure 21:
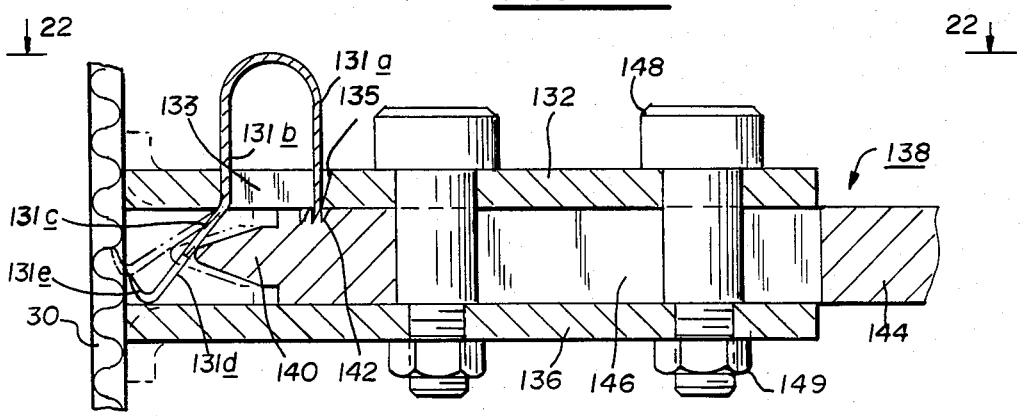
FIG. 21 represents a sectional side view partly diagrammatic and showing an alternate embodiment in which easily formed components are employed so as to minimize the cost of using.
Figure 23:
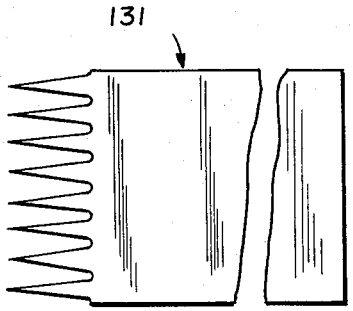
FIG. 23 represents a flat or plan view of the pin end member of spring metal and before being shaped into the configuration as in FIG. 21.
Figure 24:
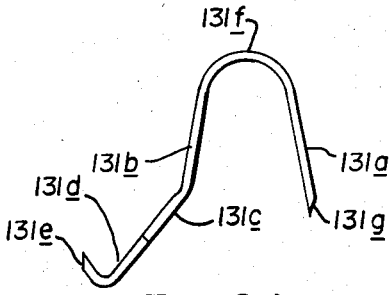
FIG. 24 represents a side view showing only the pin end member after a final shape has been made and before mounting in the retaining halves.

In operation the spring of the pin member 131 consisting of that portion 131*a*, 131*f* and 131*b* provide bias opposing forward movement of the member 138 and in addition that portion of member 131 within the upper and lower plates 132 and 136 respectively causes member 138 to be disposed toward the rear position with the shank of the front cap screw 148 against the forward portion of slot 146. As the arm or actuator moves the assembly to the left as depicted the ends or lips of plates 132 and 136 come in way of paperboard member 30. The plates 132 and 136 stop their advance but member 138 continues to move forwardly (right to left) and the cam end 140 of member 138 engages the sharpened pin end member 131 to cause this end to swing into engaging position in the paperboard. The ends of plates 132 and 136 remain in this engaged condition during transfer. Latch or maintaining means as above noted may be provided and the unlatching or release of plate members 132 and 136 to their at rest position occurs during return to a next paperboard member. The spring capability of member 131 provides the desired bias to not only cause withdrawal of the pin ends from the paperboard 30 but also to provide the necessary bias to move member 138 to its rearward position with the left end of groove 146 engaging the shank of the left cap screw 148. With the forward movement of member 138 to cause the pin ends to engage the paperboard 30 the portion 131*a* is moved toward portion 131*b*. The apparatus of FIG. 21 shows notches 142 but it is also contemplated that a shallow recess may be formed in the top surface of the member 138 and that a retaining lip be formed at the rear end of member 131.

Embodiment of FIG. 25

The embodiment of FIG. 25 is shown in Applicant's U.S. Pat. No. 3,858,490 as issued Jan. 7, 1975. This view shows an arm that is actuated with little lost motion provided in the apparatus for moving a suction cup. This embodiment has been labeled "prior art".

Embodiment of FIG. 26

The embodiment of FIG. 26 is shown in Applicant's U.S. Pat. No. 4,089,150 as issued May 16, 1958. This view shows an arm that is moved in response to a cylindrical actuation. This movement is made with a timed control of this cylinder. This view is also labeled "prior art".

In the above embodiments of Applicant's concept the sharpened pins are carried by movable members which may or may not be arms swung in an arc. Linear movement or a slide guide may also be employed as the intent is to bring a sensing end or shaft into engagement with a panel surface of a paperboard structure. This paperboard is conventionally a corrugated structure with the corrugaged member secured between front and back panels by glue or the like. The sharpened pin ends are disposed to enter the paperboard at an angle greater than forty-five degrees and to utilize a plurality of pins to locally engage and penetrate the facing panel and possibly some of the corrugations without penetrating and projecting from the rear panel.

The pins are plural in number and may be arranged in a circular, oval, irregular or linear array. These pins are disposed to mechanically engage the paperboard in a simultaneous outward or inward direction. The sharpened pin ends are portions of a pin member which is of metal and is contemplated to be hardened sufficiently to retain the sharpened end for many hours of use. The mechanical embodiments above shown and described are intended to and do accommodate irregularities in the construction of the paperboard and in particular paperboard constructions with less than flat or impervious surfaces of the type that defeat the use of suction cup devices. Mechanical actuation of the pin engagement contemplates a latching capability during any and all transfer movement during which the sharpened pin ends are engaged and are retained in the paperboard.

Stop means for limiting the movement of the sharpened pin carrying apparatus is contemplated and said means is dependent on the use of the apparatus. This stop means and movement is established by the designer of the apparatus of the machine in which the sharpened pin embodiments are used. The number and spacing of the sharpened pin embodiments are also determined by the task to be performed as small cartons need fewer or smaller assemblies than large cartons of great extents. What is intended is to depict the several embodiments available for this concept. All embodiments anticipate a sensing member to establish the engagement of the sharpened pin ends with the paperboard and that the movement of the sharpened pins into the paperboard is less than through the single thickness of the paperboard.

Although the several arrangements of sharpened pins are contemplated and are described as hardened metal, this is not to preclude plastic that may have the desired characteristics. The latch means suggested in FIGS. 5, 7 and the like are merely depictions of well known apparatus and there is not patentable significance ascribed thereto. It is desirable, whether the motion is in an arc, irregular path or a linear travel, that the engaged pin ends retain their engagement of the paperboard until the transport movement is completed at which time the pin engagement is removed. The sensing means employed in each embodiment is preferably mechanically biased as by coil springs but this does not preclude the use of pneumatic, hydraulic or electrical means for providing the desired lost motion. Positive engagement of the sharpened pin ends into the paperboard is contemplated and positive withdrawal of these same pin ends is also contemplated. The several embodiments above shown and described do not use or contemplate the use of a suction system and suction cups which are not only expensive to use with a suction system but also are subject to wear and unwanted misses in operation.

Some of the prior art devices anticipate the engagement of cloth by pins that stretch the fabric or engage leather that is sufficiently supple to be drawn to and into a tight engagement. The transfer of a paperboard member such as an unerected carton is usually by a suction or suction cups connected to a source of negative pressure as shown in the FIGS. 25 and 26 are labeled as "prior art". In the present embodiments, and as claimed, there is provided a reciprocable body that may be swung in an arc or may be moved back and forth on slide glides. Sharpened pin end members are in this body and are conventionally of sheet metal and hardened to a spring temper and possibly additionally hardened at the sharpened ends by plating or other treatments.

A sensing member, either as a plunger pin, a flanged sleeve of a guide member or like means, is adapted to engage the facing surface of the paperboard and when and while engaged the sharpened ends of the pins are cause to moved forwardly to penetrate and enter the paperboard member at an angle which is sufficient to retain the paperboard member during transfer of the paperboard member from its initial position to a remote location whereat the pin ends are caused to be retracted from the paperboard member. The penetration of the sharpened ends are sufficient for engagement but not so as to have the sharpened end penetrate the next paperboard member. The withdrawl of the sharpened pins is shown as by spring means or a spring in the pneumatic cylinder. This does not preclude the use of other positive forces such as pneumatic or an electrical solenoid. Latch means may be mechanical, pneumatic or electrical and whatever is used it is contemplated that the sharpened ends of the pins will remain in their inserted condition during and until the desired end of transfer movement.

The sharpened pin ends as carried by a body retainer member are always a plurality and usually at least four in number. The ends are disposed to turn inwardly as in FIG. 1 or outwardly as in FIG. 7 and may be arranged in a circular, oblong or linear pattern. Whatever the pattern, it is contemplated that the pin ends are sufficiently adjacent and opposed to each other to act sufficiently in concert that lateral movement of the paperboard member is not caused by the penetrating action of the pins ends. In FIG. 9 the sharpened pin members are depicted as initially formed or made as a strip. The dashed lines indicate that the sharpened members may then be cut apart or may be otherwise arranged and these dashed lines indicate cutting, but other separations may be made to suit the requirements of the installation. It is contemplated that as a strip or as individual segements the members are provided with mounting means such as apertures 41. Rapid and inexpensive replacement is contemplated Terms such as "left", "right", "up", "down", "bottom", "top", "front", "back", "in", "out" and the like are applicable to the embodiments shown and described in conjunction with the drawings. These terms are merely for the purposes of description and do not necessarily apply to the position in which the sharpened pin members and their associated apparatus may be constructed or used.

While particular embodiments of the pin ends and retaining and actuating apparatus have been shown and described, it is to be understood the invention is not limited thereto and protection is sought to the broadest extent the prior art allows.

What is claimed is:

1. Apparatus for engaging and retaining a paperboard member by a plurality of sharpened pin ends disposed to penetrate and engage facing surface of said paperboard member during a transfer motion and after transfer has been completed to release said paperboard member, this apparatus including:

(a) a reciprocable body retainer member and means for moving said retainer member to and from said paperboard member;

(b) a plurality of sharpened pin end members carried by said body member and means for moving said pin end members under controlled conditions to and into facing surface of the paperboard member at an engaging and retaining angle while the other end of said sharpened pin end members are retained in a fixed array in this body member;

(c) a sensing member carried by the reciprocable body member and adapted to engage an outer surface of a paperboard member and remain in said engaged condition during actuation of the sharpened pin members;

(d) movable means carried by said reciprocable body member for advancing the sharpened ends of the pin members a determined amount into the contiguous surface of the paperboard member engaged by said sensing member so that the sharpened ends of the pin members enter the facing surface of the paperboard member at an angle which is less than normal to the facing surface of the paperboard member and sufficient to releasably engage and retain this paperboard member;

(e) means for limiting the advance of the sharpened ends of the pins into the paperboard member so as not to penetrate a rear panel portion of the paperboard member sufficiently so as to extend therefrom;

(f) means for maintaining the controlled depth of penetration of the paperboard member by the sharpened ends of the pin members during the desired transfer movement of the reciprocable body member, and (g) means for effecting a release of the sharpened pin ends from the engaged and penetrated paperboard member after the desired transfer motion.

2. Apparatus for engaging and retaining a paperboard member as in claim 1 in which the sharpened pin members are of spring steel and are arranged to converge toward each other and a theoretical center, each sharpened pin member having like plurality of angle portions and with an intermediate angle portion of each of said pin members is engaged by a sleeve which is carried by and movable with said body retainer member, and with the forward movement of said sleeve the sharpened ends of the pin members are actuated so as to actuate the sharpened ends of the pin members into the paperboard member.

3. Apparatus for engaging and retaining a paperboard member as in claim 2 in which the means for maintaining the controlled depth of penetration of the paperboard is a pneumatic cylinder.

4. Apparatus for engaging and retaining a paperboard member as in claim 2 in which the means for maintaining the controlled depth of penetration of the paperboard is a latch member which includes a pivoted arm having an entering end disposed to enter a groove provided in a shaft which is a portion of the sensing member.

5. Apparatus for engaging and retaining a paperboard member as in claim 4 in which the pivoted arm also carries a roller disposed to be engaged by a stop member to be moved from the groove and release the sensing shaft.

6. Apparatus for engaging and retaining a paperboard member as in claim 4 in which the sharpened pin end members are secured to a support collar and this collar member is biased to an outer limit by a spring means.

7. Apparatus for engaging and retaining a paperboard member as in claim 1 in which the sharpened pin members are of spring steel and are arranged in two linear rows so as to converge toward each other and as arranged having a plurality of sharpened ends with each member having like plurality of angle portions and with an intermediate angle portion of each of said pin members is engaged by a sleeve which is carried by and movable with said body retainer member, and with the forward movement of said sleeve the sharpened ends of the pin members are actuated so as to actuate the sharpened ends of the pin members into the paperboard member.

8. Apparatus for engaging and retaining a paperboard member as in claim 7 in which each pin end member is formed with plural ends and in a linear array.

9. Apparatus for engaging and retaining a paperboard member as in claim 1 in which the sensing member is a sleeve that is spring biased toward the paperboard member and the sharpened pin end members are disposed so that the sharpened ends are moved outwardly and each pin end is formed with a plurality of angle portions and with an intermediate portion of the pin member engaged and urged outwardly by a cam member carried by and secured to said body member.

10. Apparatus for engaging and retaining a paperboard member as in claim 9 in which the sensing sleeve also has a lip disposed to be engaged by a latch dog when the sharpened pin ends are in their penetrating condition and with means for actuating the latch dog so as to release the sensing sleeve at the end of the transfer movement.

11. Apparatus for engaging and retaining a paperboard member as in claim 10 in which the sharpened pin end members are carried between an inner collar and the sensing sleeve which is disposed outwardly of the pin end members, the sharpened pin end members movable with the sensing sleeve.

12. Apparatus for engaging and retaining a paperboard member as in claim 1 in which the sharpened ends of the pins are constructed and positioned so as to intermesh at their sharpened end portions in a determined extent and the pin ends are urged apart and insertion of the sharpened pin ends into the paperboard is achieved by a cam member carried by the body retainer member and the other ends of the sharpened pin members are secured to a retainer also secured to a movable sleeve member which sleeve member is disposed outwardly of the sharpened pin end members.

13. Apparatus for engaging and retaining a paperboard member as in claim 12 in which the movable sleeve member situated outwardly of the sharpened pin ends has an outwardly extending lip portion and this same movable sleeve member at its inner end is slidably retained and guided by a Z-shaped member having one end secured to and movable with the body retainer member.

14. Apparatus for engaging and retaining a paperboard member as in claim 13 in which the Z-shaped members are plural in number and the sensing sleeve has an outwardly formed latch engaging portion that comes in way of and engages a latch at the forward limit of movement of the latch whereby the sharpened pin ends enter and engage the paperboard and remain in this condition during transfer motion and at the termination of the transfer motion the latch engaging portion is actuated to a release condition to permit a return of the pin ends to a non-engaging condition and a withdrawal of the sharpened pin ends from the paperboard.

15. Apparatus for engaging and retaining a paperboard member as in claim 12 in which the cam member is a shaped plug movable between intermediate portions of the intermeshed sharpened pin ends and with a forward movement of the cam member said sharpened pin ends are moved away from each other and counterflow movement of the body retainer member causes the cam member to reduce the cam actuation and the sharpened pin ends to move toward each other.

16. Apparatus for engaging and retaining a paperboard member as in claim 15 in which the movable sleeve member is biased outwardly towards the paperboard member by means interposed between the sleeve and the movable body member.

17. Apparatus for engaging and retaining a paperboard member as in claim 1 in which the sharpened pin end members are carried at their unsharpened ends by L-shaped members which L-shaped members are secured at their outer first ends to a sensing sleeve biased outwardly to a determined limit and with the other second ends of the L-shaped members secured to a member movable with the sensing sleeve to a determined outer limit.

18. Apparatus for engaging and retaining a paperboard member as in claim 17 in which the L-shaped members are plural in number and there is provided a plurality of extending finger-like cam members providing space therebetween through which the L-shaped members are carried, each cam member having means for securing said member to the body retainer member and the extending fingerlike cam members are disposed to pass between the L-shaped members with said extending ends disposed to engage the outer surface of a sharpened pin member intermediate its ends and with outward movement of the cam member relative to the sensing sleeve the cam members engage and urge the sharpened pin end members into the paperboard.

19. Apparatus for engaging and retaining a paperboard member as in claim 18 in which the extending ends of the cam fingers are in a contiguous relationship and are supported against outward deflection by movably carrying said extending ends of the cam fingers within the sensing sleeve.

20. Apparatus for engaging and retaining a paperboard member as in claim 19 in which there is a bias which urges the sensing sleeve outwardly which bias is a spring interposed between the body retainer member and outwardly of the sensing sleeve.

21. Apparatus for engaging and retaining a paperboard member as in claim 20 in which the L-shaped members are secured to each other at their ends opposite the sensing sleeve.

22. Apparatus for engaging and retaining a paperboard member as in claim 1 in which each sharpened pin end member is carried by a pivoted lever which is actuated by means carried by the body retainer member and with the pivoted levers arranged as opposed pairs with the pivot of said lever carried by the sensing means and movable therewith.

23. Apparatus for engaging and retaining a paperboard member as in claim 1 in which the sharpened pin end members are disposed in opposed array and arranged so that at least one sharpened pin member is carried by a pivoted lever and with support means carried by the sensing means and providing a support for at least two pivoted levers and with the levers moved in concert by a plate means which is secured to the reciprocable body retainer member.

24. Apparatus for engaging and retaining a paperboard member as in claim 23 in which the sensing plunger is formed with a groove and a latch member and is pivotally carried with and by the body retainer member, said latch member having a dog end disposed to be moved into said groove to provide means for maintaining the sharpened pin ends in an engaged condition and after transfer to engage said latch member to cause the dog end to be moved from the groove and the removal effecting release of the engaged sharpened pin ends.

25. Apparatus for engaging and retaining a paperboard member as in claim 24 in which each of the pivoted levers has a roller that is disposed to engage the plate means and roll over a surface provided thereby, said roller when moved over this surface requiring only rolling friction.

26. Apparatus for engaging and retaining a paperboard member as in claim 24 in which the sharpened pin end members are disposed in a substantially circular array.

27. Apparatus for engaging and retaining a paperboard member as in claim 24 in which the sharpened pin end members are disposed in substantially parallel linear arrays.

28. Apparatus for engaging and retaining a paperboard member as in claim 23 in which the sensing plunger also carries on its paperboard sensing end an attached plate member adapted so as to be substantially normal to the axis of the sensing plunger and in which the attached plate is provided with cutouts through which the sharpened ends of the pin members are moved to and into the paperboard and at the withdrawal of the sharpened pin ends from the paperboard these same ends move through these same cutouts.

29. Apparatus for engaging and retaining a paperboard member by a plurality of sharpened pin ends disposed to penetrate and engage a facing surface of said paperboard member during a transfer motion and after transfer has been completed to release said paperboard member, this apparatus including:

(a) a reciprocable body retainer member and means for moving said retainer member toward and away from said paperboard member;

(b) a plurality of sharpened pin end portions each of which is made from self-coiling stip spring metal and with each pin end portion as a strip having a first sharpened end and a second retaining end, these pin portions carried by said body member and means for moving said pin end members under controlled conditions to and into facing surface of the paperboard member with the end curling when not retained in a straightened condition;

(c) opposed guide means providing slide and retaining surfaces for the strip spring portion between the first end and the second retaining end, these guide means having surface portions disposed to engage the outer surface of the paperboard and provide sensing means therewith, these guide means carried by the body retainer member and the guide means independently movable with respect to said body member, these surface portions of the guide means adapted to engage an outer surface of a paperboard member and remain in said engaged condition during insertion of the sharpened pin members, the independent movement of the guide means and the body member including biasing means urging the body member away from the engaging portions of the guide means and establishing the forward limit of the guide means when the sharpened pin ends are in a non-engaged condition in the paperboard;

(d) movable means carried by said reciprocable body member for advancing said self-coiling strips between said guide means so that the sharpened end of the pins as they emerge from the guide means curl and as advanced penetrate the paperboard and continue to curl to provide a curved gripping of the penetrated paperboard, this movable means also sufficient to releasably engage and retain this paperboard member;

(e) means for limiting the advance and curl of the sharpened ends of the pins into the paperboard member so as not to penetrate a rear panel portion of the paperboard member sufficiently so as to extend therefrom;

(f) means for maintaining the controlled depth of penetration of the paperboard member by the curled sharpened ends of the pin members during the desired transfer movement of the reciprocable body member, and (g) means for effecting a release of the sharpened pin ends from the engaged and penetrated paperboard member after the desired transfer motion, the curl of the strip spring metal portion disposed to establish the desired penetration and gripping action.

30. Apparatus for engaging and retaining a paperboard member as in claim 29 in which the metal strip is of steel and the guide means are opposed members disposed in pairs and in substantially parallel array and with said members secured together as pairs and further disposed so as to be two pairs of guide means carried by the body retainer member and with a spring providing the bias means.

31. Apparatus for engaging and retaining a paperboard member as in claim 30 in which the curl of the steel strip is disposed to curl outwardly and away from a similarly disposed strip.

32. Apparatus for engaging and retaining a paperboard member as in claim 30 in which the curl of the steel strip is disposed to curl toward a similarly disposed strip.

33. Apparatus for engaging and retaining a paperboard member as in claim 30 in which each strip is secured at its retained end by a retaining lug and one of the guide members has a stop establishing the outward movement of the reciprocable body member which is also the actuator and the relative position of the movable guides.

34. Apparatus for engaging and retaining a paperboard member as in claim 33 in which the actuator has an attached spacer disposed to engage the retaining lug and establish the sharpened point of the pin ends at the forward and engaging surface of the guides and with the spring bias provided by a compression spring interposed between the actuator body and the guide means.

35. Apparatus for engaging and retaining a paperboard member by a plurality of sharpened pin ends by penetrating and engaging a facing surface of said paperboard member during a transfer motion and after transfer motion has been completed releasing said paperboard member, this apparatus including:

(a) a movable member and means for moving said member toward and from said paperboard member;

(b) a plurality of sharpened pin ends formed as a part of a sheet metal member, the pin ends as tips, each at the apex of a triangular portion extending from a solid sheet portion and adapted for swinging said pin ends under controlled conditions to and into a facing surface portion of the paperboard member, said swinging motion causing said pin ends to enter the paperboard at an engaging and retaining angle, the solid portion of the sheet metal member at least in part formed as a curved strip (horse-shoe shaped) spring to provide a determined bias;

(c) top and bottom plate members slidable on said movable member and providing contacting means adapted to engage the outer surface of a paperboard member and disposed to be moved from a forward position whereat the pin ends are in a non-engaging position and to a rear position whereat the pin ends are in an engaged position and means for retaining said outer plate members in the engaged condition during the desired penetration of the pin ends in the paperboard;

(d) cam means carried by the forward end of the movable body member and as this cam means is advanced between the top and bottom plate members adapted to engage triangular portions of the sheet metal member and swing the ends a determined amount into the contiguous surface of the paperboard member in contact with the top and bottom plate members, the pin ends entering at an angle which is less than normal to the facing surface of the paperboard member and sufficient to releasably engage and retain this paperboard member during transfer;

(e) means for limiting the advance of the sharpened ends of the pins into the paperboard member so as not to penetrate a rear panel portion of the paperboard member sufficiently so as to extend therefrom;

(f) means for maintaining the controlled depth of penetration of the paperboard member by the sharpened ends of the pin members during the desired transfer movement of the movable member, and (g) means for effecting a release of the sharpened pin ends from the engaged and penetrated paperboard member after the desired transfer motion.

36. Apparatus for engaging and retaining a paperboard member as in claim 35 in which one of the plates is formed with at least one aperture through which the curved spring portion extends and providing therewith a spring bias adapted to swing the pin ends from engagement with the paperboard and urge the plate members to a forward limit position.

37. Apparatus for engaging and retaining a paperboard member as in claim 36 in which the aperture through which the spring portion extends has a bevel formed on that edge away from the surface disposed to contact the paperboard, said bevel adapted to assist in the bending of the spring portion extending from the plate member.

38. Apparatus for engaging and retaining a paperboard member as in claim 37 in which the movable member is formed with a contoured nose end forming a cam means disposed to engage the triangular portions of the pin end member and provide the desired swinging motion.

39. Apparatus for engaging and retaining a paperboard member as in claim 38 in which the movable member is formed with a slot providing the forward and rearward limit of motion of the upper and lower plate members relative to the movable member and said upper and lower plate members are retained in the desired spaced array and position by cap screws and threaded retaining means extending through appropriately sized and positioned holes in the plate members.

40. Apparatus for engaging and retaining a paperboard member as in claim 39 in which the movable member is formed with a plurality of notches adapted to receive and retain the rear end of the sheet metal member in which is formed the pin ends.

41. A method for apparatus for engaging and retaining a paperboard member by a plurality of sharpened pin ends by penetrating and engaging a facing surface of said paperboard member during a transfer motion and after transfer motion has been completed releasing said paperboard member, these method steps including:

(a) reciprocably moving a body retainer member to and from said paperboard member;

(b) carrying a plurality of sharpened pin end members in and by said body member and moving said pin end members under controlled conditions to and into facing surface of the paperboard member at an engaging and retaining angle;

(c) positioning a sensing member and carrying said sensing member by the reciprocable body member so as to engage an outer surface of a paperboard member and causing said pin ends to remain in said engaged condition during actuation of the sharpened pin members;

(d) providing movable means carried by said reciprocable body member so that the sharpened ends of the pin members are advanced a determined amount into the contiguous surface of the paperboard member engaged by said sensing member causing the sharpened ends of the pin members to enter the facing surface of the paperboard member at an angle which is less than normal to the facing surface of the paperboard member and at an angle which is sufficient to releasably engage and retain this paperboard member;

(e) limiting the advance of the sharpened ends of the pins into the paperboard member so as not to penetrate and extend from a rear panel portion of the paperboard member;

(f) maintaining the controlled depth of penetration of the paperboard member by the sharpened ends of the pin members during the desired transfer movement of the reciprocable body member, and (g) effecting a release of the sharpened pin ends from the engaged and penetrated paperboard member after the desired transfer motion.

42. A method for engaging and retaining a paperboard member as in claim 41 which further includes the step of arranging the plurality of sharpened pins in a substantially circular pattern.

43. A method for engaging and retaining a paperboard member as in claim 42 which further includes the step of arranging the plurality of sharpened pins so that the pin ends move outwardly away from each other.

44. A method for engaging and retaining a paperboard member as in claim 42 which further includes the step of arranging the plurality of sharpened pins so that the pin ends move inwardly toward each other.

45. A method for engaging and retaining a paperboard member as in claim 41 which further includes the step of arranging the plurality of sharpened pins in a substantially linear array.

46. A method for engaging and retaining a paperboard member as in claim 45 which further includes the step of arranging the plurality of sharpened pins so that the pin ends move outwardly away from each other.

47. A method for engaging and retaining a paperboard member as in claim 45 which further includes the step of arranging the plurality of sharpened pins so that the pin ends move inwardly toward each other.

* * * * *